US005704500A

United States Patent [19]

Hoffmann et al.

[11] Patent Number: 5,704,500

[45] Date of Patent: Jan. 6, 1998

[54] DISPENSING-SEALING ARRANGEMENT FOR A CONTAINER

[76] Inventors: David John Hoffmann, 110A Halc Road, Wembley Downs, W.A. 6019; Robert Anthony James Hunter, 5 Lorne Place, Mandurah, W.A. 6210, both of Australia

[21] Appl. No.: 564,118

[22] PCT Filed: Jun. 16, 1994

[86] PCT No.: PCT/AU94/00327

§ 371 Date: May 16, 1996

§ 102(e) Date: May 16, 1996

[87] PCT Pub. No.: WO94/28856

PCT Pub. Date: Dec. 22, 1994

[30] Foreign Application Priority Data

Jun. 16, 1993 [AU] Australia ..... PL9429

[51] Int. Cl.[6] ..... A61J 9/08

[52] U.S. Cl. ..... 215/11.6; 215/354

[58] Field of Search ..... 215/11.1, 11.5, 215/11.6, 231, 354; 220/254; 222/111, 529, 562; D24/197

[56] References Cited

U.S. PATENT DOCUMENTS

| | | | |
|---|---|---|---|
| D. 349,769 | 8/1994 | Green | D24/197 |
| 2,434,611 | 1/1948 | Hamiel | 215/11.5 |
| 2,480,247 | 8/1949 | Jamison et al. | 215/11.6 |
| 2,571,010 | 10/1951 | Busch | 215/11.5 |
| 3,298,577 | 1/1967 | Chlystun | 222/529 |
| 3,301,423 | 1/1967 | Soto . | |
| 3,531,009 | 9/1970 | Saperstein | 215/11.6 |
| 3,572,533 | 3/1971 | Koll | 215/11.6 |
| 3,952,897 | 4/1976 | Pickerall et al. . | |
| 4,193,506 | 3/1980 | Trindle et al. | 215/11.6 |
| 5,088,632 | 2/1992 | Odet et al. | 222/529 |
| 5,105,961 | 4/1992 | Noren et al. | 215/354 X |

FOREIGN PATENT DOCUMENTS

| | | | |
|---|---|---|---|
| 51032 | 12/1935 | Denmark | 215/11.5 |
| 3811730 | 7/1989 | Germany . | |
| 654932 | 6/1963 | Italy | 215/11.6 |
| 884691 | 12/1961 | United Kingdom . | |
| 1013653 | 12/1965 | United Kingdom . | |
| 2003039 | 3/1979 | United Kingdom . | |
| 2029379 | 3/1980 | United Kingdom . | |

*Primary Examiner*—Allan N. Shoap
*Assistant Examiner*—Christopher J. McDonald
*Attorney, Agent, or Firm*—Merchant, Gould, Smith, Edell, Welter & Schmidt, P.A.

[57] ABSTRACT

A dispensing-sealing arrangement (10) is disclosed for a container (12) comprising a resiliently deformable dispensing apparatus typically in the form of a teat (14) connected about opening (16) of the container (12). The teat (14) is provided with an outlet (18) for dispensing matter contained in the container (12). Cap (20) is provided with a skirt (22) for insertion into the opening (16) for sealing the container (12). Sealing is achieved by the skirt (22) deforming the teat (14) in the manner so that a first portion (24) of the teat is sandwiched between the opening (16) and the skirt (22). The skirt (22) is configured so that sufficient pressure is applied to the teat (14) to ensure positive sealing between the teat and the first skirt (22). The skirt (22) is located in board of the periphery of, and depends from, upper wall (26) of cap (20). Inner surface (28) of skirt (22) together with the portion of the upper wall (26) bound by the skirt (22) defines a recess (32) for engaging a second portion (30) of the teat (14). The second portion (30) is located upstream of the first portion (24) and includes the outlet (18). Engagement of the second portion (30) in recess (32) is achieved by resilient deformation of the second portion against the inner surface (28) of the first skirt (22). When cap (20) is removed, it initially extends the teat (14) from the opening (16) due to the engagement of the second portion (30) in the recess (32).

20 Claims, 4 Drawing Sheets

DISPENSING-SEALING ARRANGEMENT FOR A CONTAINER

FIELD OF THE INVENTION

The present invention relates to a dispensing-sealing arrangement for a container.

BACKGROUND OF THE INVENTION

There is a need to provide a dispensing-sealing arrangement for a container which allows both the convenient transferring of the contents of the container to the user and the ability to re-seal the container to prevent the leakage of the contents and maintain its integrity. One example of this is the humble baby bottle. A major drawback With the use of baby bottles is the need to sterilize the bottle and associate teat prior to use. At times it would be of greater convenience to use a disposable pre-filled baby bottle if such were available. It is thought that one reason why such bottles are not widely available is the difficulty in providing a reliable arrangement for dispensing the contents of the baby bottle and sealing the baby bottle in a manner so as to minimise contamination of the contents.

It is also known that the screw caps on many carbonated drink bottles do not maintain the integrity of the contents in that after initially opening the bottle and resealing, the caps allow the leakage of carbon-dioxide resulting in the drink becoming flat.

SUMMARY OF THE INVENTION

It is an object of the present invention to provide a dispensing-sealing arrangement for a container which attempts to alleviate at least one of the disadvantages in the above-described prior art.

According to the present invention there is provided a dispensing-sealing arrangement for a container comprising:

- a resiliently deformable dispensing means for connection to an opening of said container and having an outlet for dispensing matter contained in the container; and,
- a cap provided with sealing means for insertion into said opening for sealing said container by deforming said dispensing means in such a manner that a first portion of said dispensing means is sandwiched between said opening and said sealing means, said sealing means being configured so that sufficient pressure is applied to the dispensing means to ensure positive sealing between the dispensing means and sealing means.

Preferably, said sealing means is provided with releasable engaging means for releasably engaging a second portion of said dispensing means when the cap is inserted into said opening whereby, in use, said cap, when removed from said opening, initially extends said dispensing means from said opening and is subsequently released from said dispensing means.

Preferably, said sealing means comprises a first skirt depending from an upper wall of said cap, said first skirt having an inner surface which, together with said upper wall, defines said engaging means for engaging said second portion by resiliently deforming said second portion against said inner surface of the first skirt.

Preferably, said outlet is located in said second portion of the dispensing means and said first skirt is configured so that said outlet abuts said upper wall when the second portion of the dispensing means is engaged in the engaging means thereby sealing the outlet.

Preferably, said cap further comprises a second skirt depending from a peripheral edge of said upper wall in the same direction as said first skirt, said second skirt being configured to fit over and releasably engage an exterior surface of said container.

Preferably, said second skirt is further configured so as to form a seal about said exterior surface.

In an alternate form said dispensing means further comprises a third portion depending from said first portion and adapted for extending through said opening into said container to a position where it can overlie a bleed hole provided in the container, whereby, when said cap is removed from said opening and the difference between ambient atmospheric pressure and pressure inside said container is greater than a predetermined pressure said third portion acts to allow fluid communication between the atmosphere and the inside of container through said bleed hole, and when said difference is less than or equal to said predetermined pressure said third portion seals said bleed hole to substantially prevent escape of contents of said container through bleed hole, and when said cap is inserted into said opening said cap deforms said dispensing means in such a manner that said first portion and said third portion are sandwiched between said opening and said sealing means with said third portion overlying said bleed hole to positively seal said opening and bleed hole.

Preferably, said dispensing means comprises a teat or a spout.

BRIEF DESCRIPTION OF THE DRAWINGS

Two embodiments of the present invention will now be described by way of example only with reference to the accompanying drawings in which.

DETAILED DESCRIPTION OF THE PREFERRED EMBODIMENT

Figure 2:
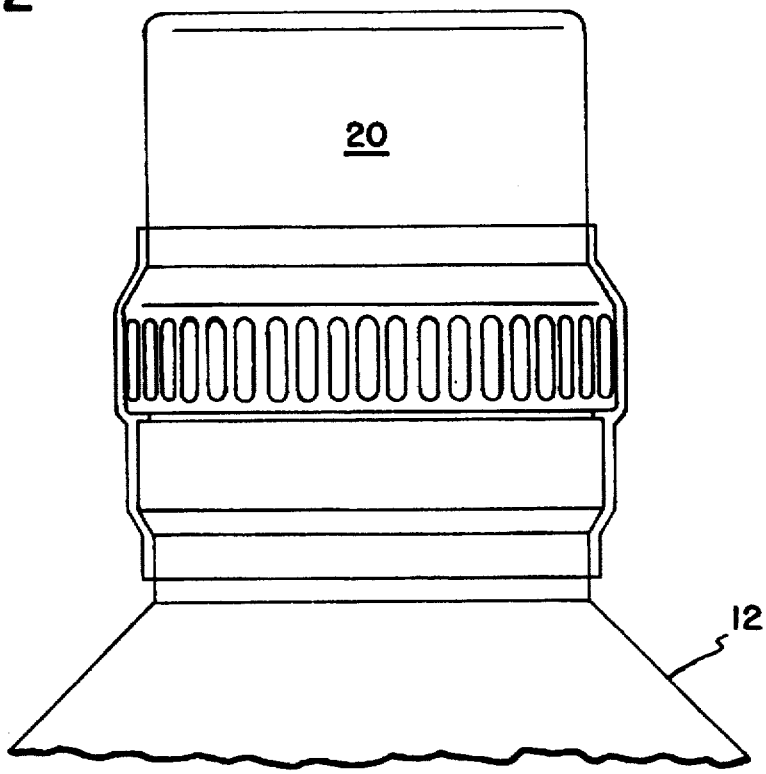
FIG. 2 is a front view of the dispensing-sealing arrangement illustrated in Figure i connected with a container.
Figure 1:
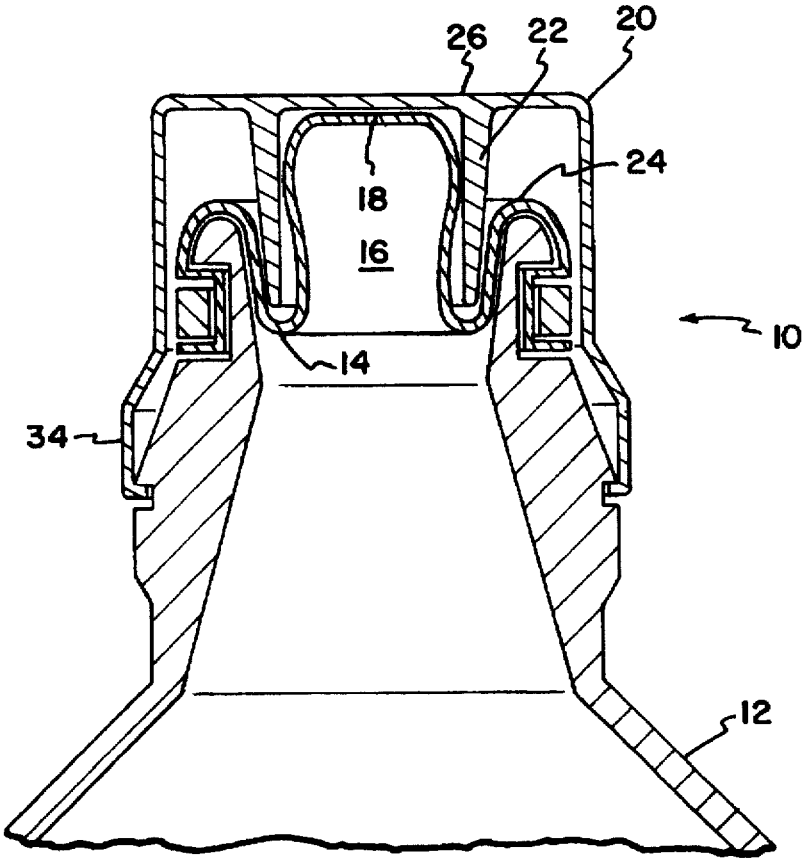
FIG. 1 is a cross-sectional view of a first embodiment of the dispensing-sealing arrangement for a container.
Figure 3:
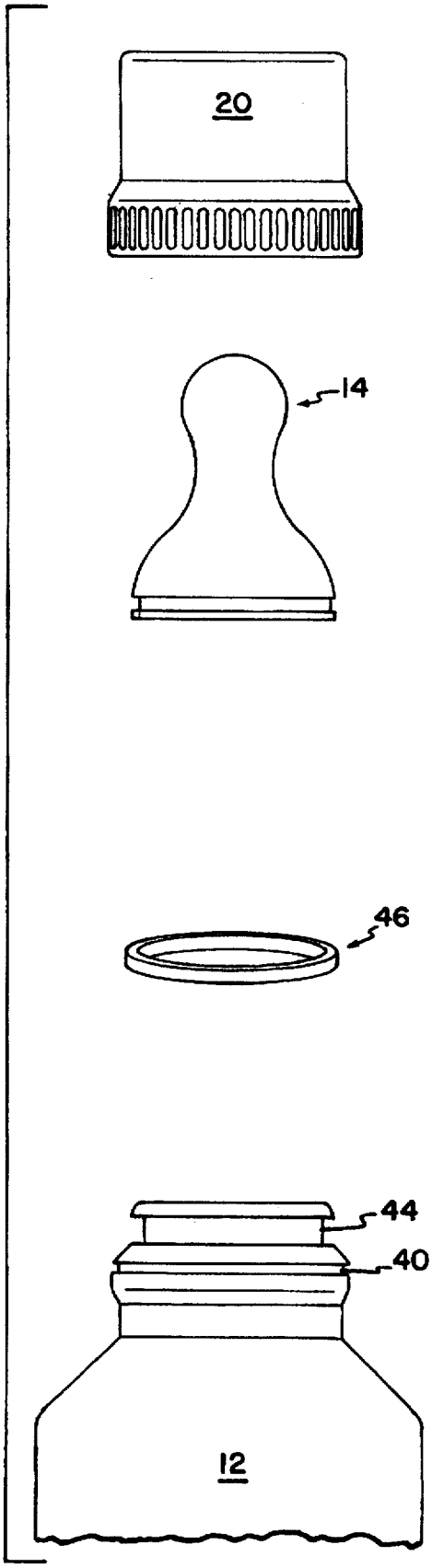
FIG. 3 is an exploded view of the dispensing-sealing arrangement shown in FIGS. 1 and 2.

In the first embodiment shown in FIGS. 1 to 4 of the accompanying drawings, a dispensing-sealing arrangement (hereinafter referred to as "the arrangement") 10 for a container 12 comprises a resiliently deformable dispensing means in the form of a teat 14 connected about an opening 16 of the container 12. The teat 14 is provided with an outlet 18 in the form of a hole formed in an upper region of the teat for dispensing matter contained in the container 12. A cap 20 is provided with sealing means in the form of a skirt 22 for insertion into the opening 16 for sealing the container 12. As seen most clearly in FIG. 1, sealing is achieved by the first skirt 22 deforming the teat 14 in a manner so that a first portion 24 of the teat 14 is sandwiched between the opening 16 and the first skirt 22. The first skirt 22 is configured so that sufficient pressure is applied to the teat 24 to ensure positive sealing between the teat and the first skirt 22.

The first skirt 22 is located inboard of the periphery of, and depends from, an upper wall 26 of the cap 20. The inner surface 28 of the first skirt 22 together with the portion of the upper wall 26 bound by the first skirt 22 defines an engaging means or recess 32 for engaging a second portion 30 of the beat 14. The second portion 30 is located upstream of the first portion 24 and includes the outlet 18. Engagement of the second portion 30 in the recess 32 is achieved by resilient deformation of the second portion against the inner surface 28 of the first skirt 22. The first skirt 22 is advantageously configured so that the outlet 18 abuts the upper wall 26 so as to seal the outlet When the cap 20 is removed from the opening it initially extends the teat 14 from the opening due to the engagement of the second portion 30 in the recess 32. Upon further upward movement of the cap 20, the second portion 30 is subsequently released from the recess 32. The matter contained within the container 12 can now be dispensed through the outlet 18.

The cap 20 is also provided with a second skirt 34 depending from a peripheral edge of the upper wall 26 in the same direction as the first skirt 22. The second skirt 34 is configured to fit over and releasably engage an exterior surface 36 of the container 12. It is advantageous that the second skirt 34 be further configured so as to form a seal about the exterior surface 36.

Figure 4:
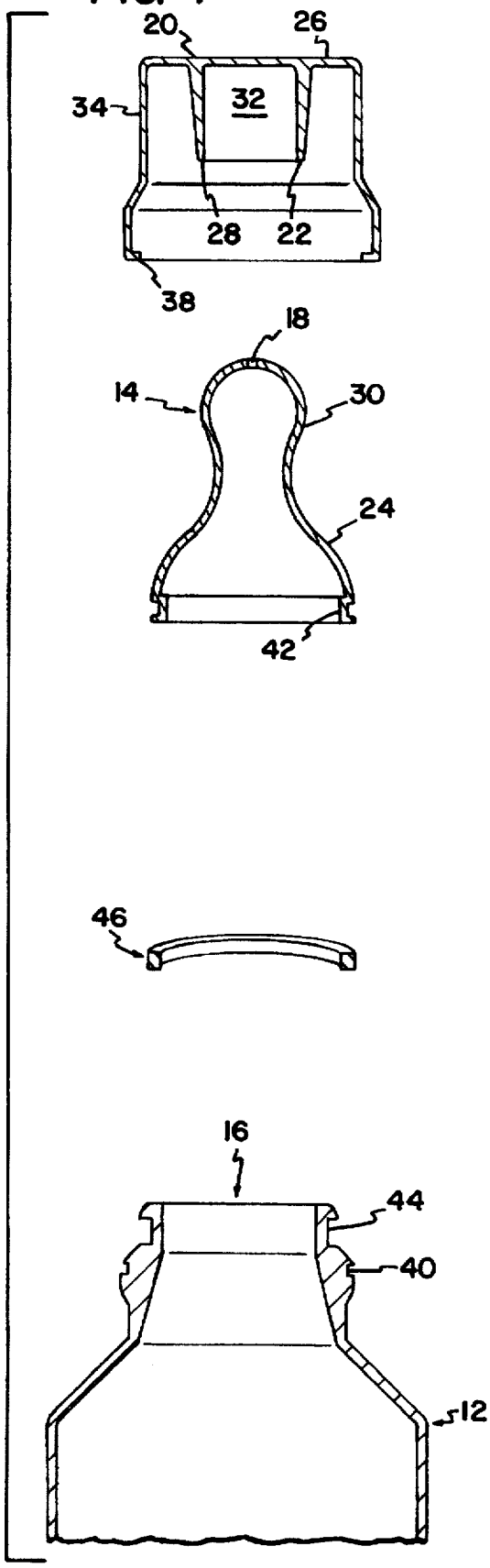
FIG. 4 is a cross-sectional view of the dispensing-sealing arrangement shown in FIG. 3.

As seen most clearly in FIG. 4, the free end of the skirt 34 is provided with an inwardly extending flange 38 for engagement with an annular recess 40 formed about the exterior surface 36, so as to form a snap fit. The teat 14 fits over and is connected to the exterior surface 36 of the container 12. This is achieved by forming a recessed annular ring 42 in a lower part of the first portion 24 and a complementary annular recess 44 in the exterior surface 36 upstream of annular recess 40. The annular ring 42 is seated in the recess 44 and a retaining ring 46 is placed over the ring 42 to be connect the teat 14 to the container 12.

Figure 5:
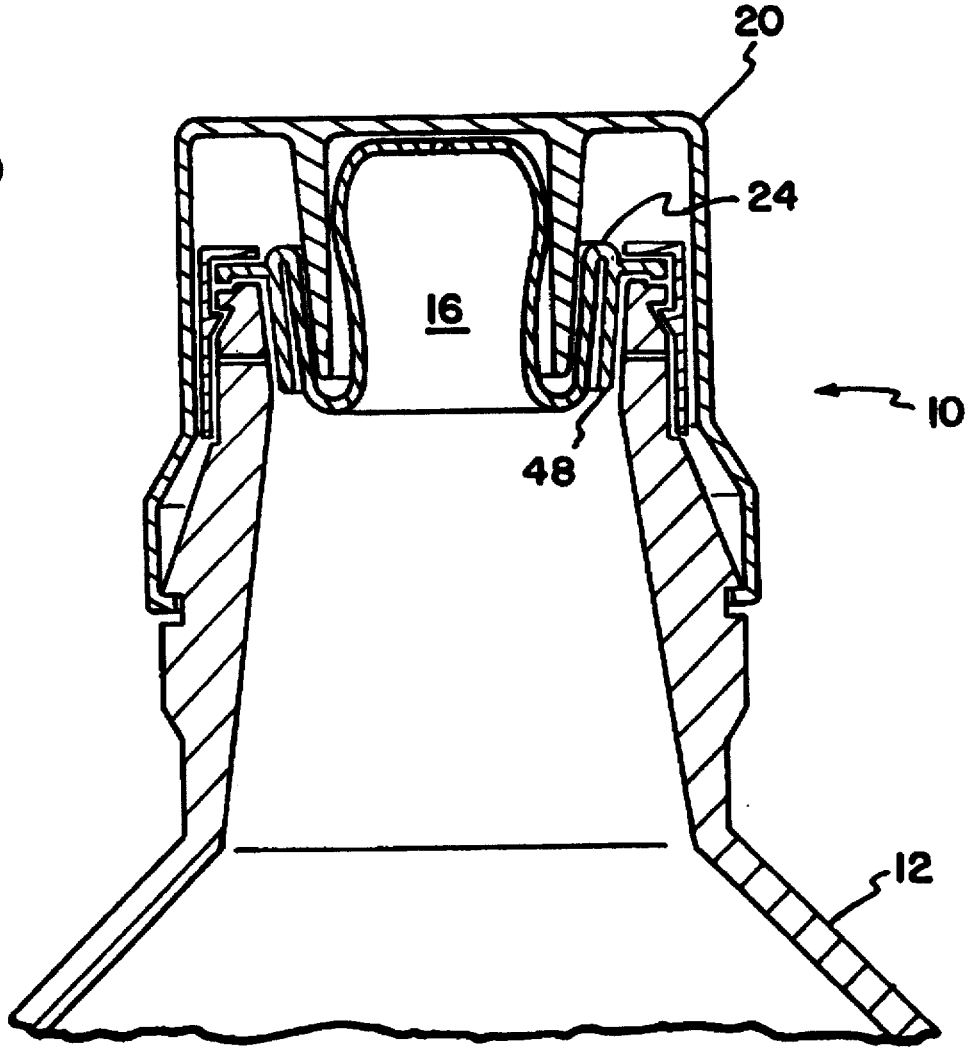
FIG. 5 is a cross-sectional view of a second embodiment of the dispensing-sealing arrangement for a container in a fully sealed state.
Figure 6:
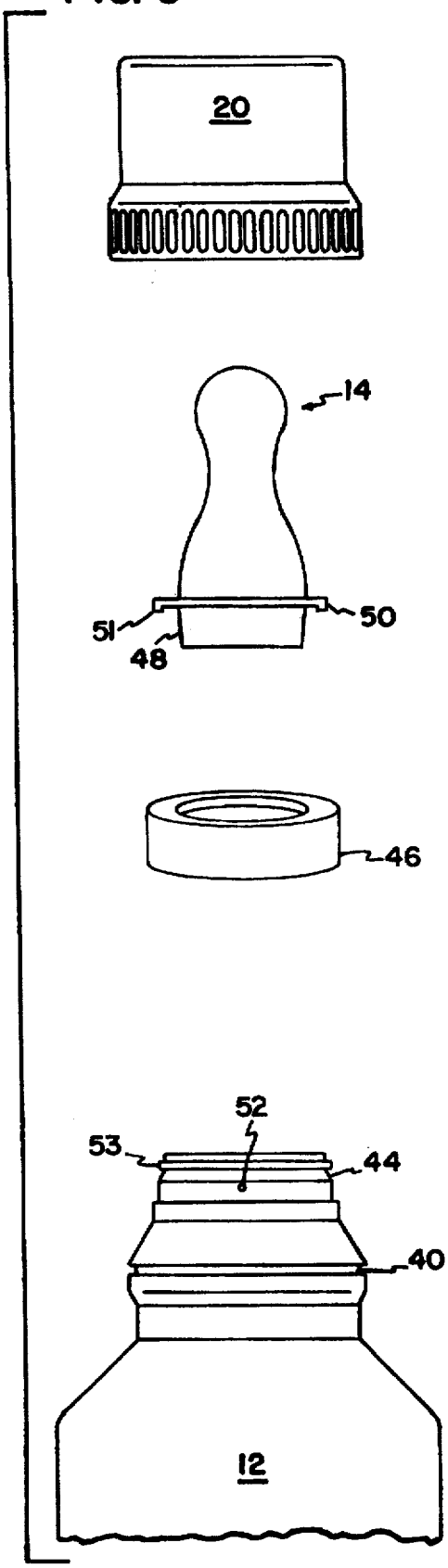
FIG. 6 is an exploded view of the dispensing-sealing arrangement shown in FIG. 5; and, FIG. 7 is a cross-sectional view of the dispensing-sealing arrangement illustrated in FIG. 6.
Figure 7:
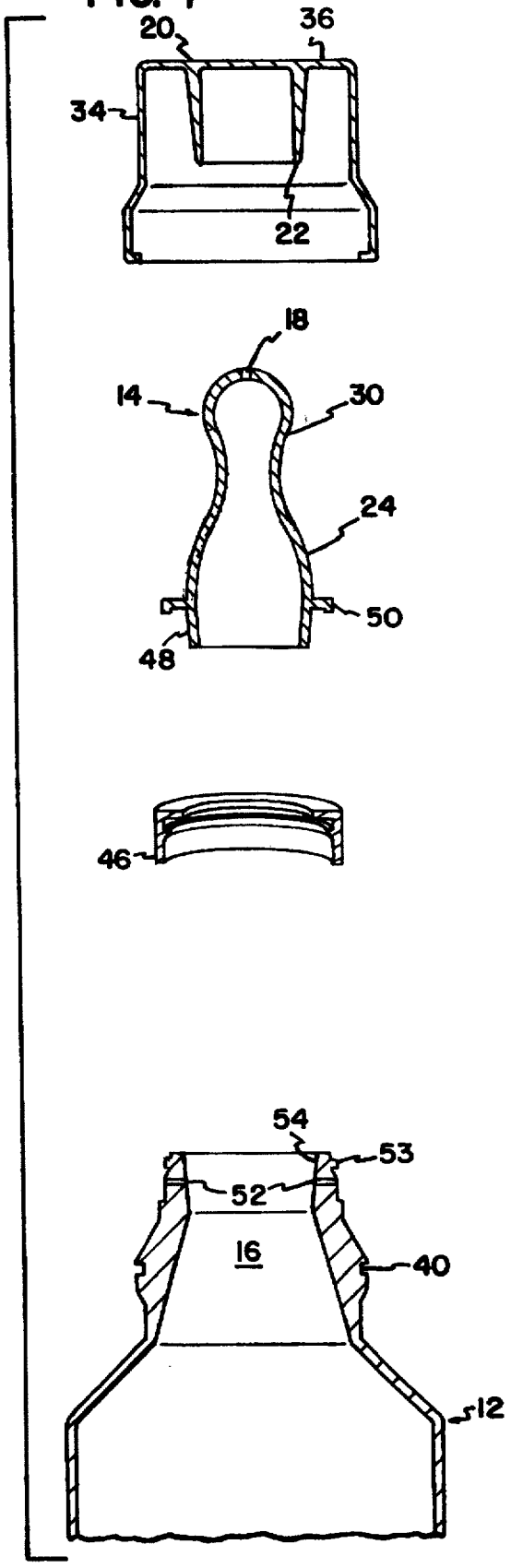

In the second embodiment shown in FIGS. 5 to 7, like numbers are used to denote like features. The most significant difference between the first and second embodiments is the form of the teat 14. The teat 14 in the second embodiment includes a third portion 48 depending from the first portion 24 adapted to extend through the opening 16 into the container 12. In addition, the annular ring 42 of the first embodiment used for connecting the teat to the container 12 is replaced with an annular flange 50 extending laterally of the exterior surface of the teat 14. A peripheral lip 51 is formed on the underside of flange 50 to seat on an upper side of shoulder 53 provided about mouth 54 of opening 16. The third portion 48 extends into the container 12 to a position where it can overlie bleed holes 52 formed near the opening of the container 12. Retaining ring 46 clamps the flange 50 to the mouth 54 of the opening 16 to connect the teat 14 to the container 12. The side wall of ring 46 loosely covers bleed holes 52 so as to not block or seal the holes 52. The cap 20 is substantially identical to that of the first embodiment.

One purpose of the third portion 48, in conjunction with bleed holes 52, is to allow substantially continuous dispensing of matter through the teat 14 without the need for "letting go" to allow air to enter container 12 through opening 18 for pressure equalisation. If for example the arrangement 10 is used for a baby's bottle containing milk and the baby were to suckle teat 14, then a vacuum would be created within the bottle 12 proportional to the amount of milk drunk by the baby. There will come a point in which the vacuum created in the bottle 12 is so great that it could not be overcome by the baby in which case no more milk could be dispensed from the teat 14. In the prior art, when this occurs, the baby would let go of the teat allowing air to rush into the bottle 12 to fill the vacuum created and then commence drinking again. In this embodiment, when the difference between ambient atmospheric pressure and fluid pressure inside the container is greater than or equal to a predetermined pressure, the third portion 48 becomes distorted and is lifted away from the interior surface of the container 12 to allow fluid communication between the atmosphere and inside of the container through bleed holes 52. This allows air to enter the container 12 to fill a vacuum created by the dispensing of contents through the teat In effect, the third portion 48 and bleed holes 52 act as a valve. When the pressure difference is less than the predetermined pressure, the third portion 48 seals the bleed holes 52 to substantially prevent escape of contained matter through the bleed holes 52. The predetermined pressure is largely dependent upon the physical characteristics of the third portion 48 and in particular its thickness and composition.

A vacuum is also created when the arrangement 10 is attached to a pre-filled container which is heated for sterilisation purposes. This occurs as the container cools to ambient temperature which results in a reduction in the volume of any air within the container thereby creating the vacuum. When the cap 20 is initially removed it extends the teat 14 from the opening effectively increasing the interior volume of the container and leading to a further reduction in air pressure.

When difference between ambient atmospheric pressure and air pressure inside the container is greater than the predetermined pressure, the third portion 48 again acts to allow air into the container through bleed holes 48 to fill the vacuum which reduces the force required fully extend the teat 14, thereby assisting in the use of the container.

The operation of the arrangement 10 in the second embodiment is, except for as described above, in substance the same as that of the first embodiment. In this regard, it is to be noted that in FIG. 5 the first portion 24 and third portion 48 are shown with a space therebetween for clarity purposes only. In reality, the first and third portions would be pressed together and sandwiched between the skirt 22 and opening 16.

It is apparent from the foregoing description that the arrangement 10 allows for the convenient dispensing and sealing of containers and is particularly well suited for application with both disposable and reusable baby bottles and other drink containers. The arrangement 10 can provide up to five separate seals to prevent leakage of the contents of the container. These seals being: the sealing of the outlet 18 against the upper wall 26; a seal formed about the second portion 30 by virtue of its resilient deformation and abutment against the inner surface 28 of the first skirt 22; a seal formed between an outer surface of the first skirt 22 and an outer surface of the teat 14; a seal formed between an inner surface of the teat 14 and an inner surface of the opening 16; and finally a seal formed between the second skirt 34 and the exterior surface 36 of the container 12 (in the first embodiment) and the retaining ring 46 (in the second embodiment).

The formation of the above seals also assist in maintaining the integrity of the contents by minimising the likelihood of contaminants entering the container 12 and/or retaining components of the contents within the container which may have become disassociated, for example carbon dioxide in a carbonated drink.

Now that embodiments of the present invention has been described in detail, it will be apparent to those skilled in the relevant arts that numerous modifications and variations may be made without departing from the basic inventive concepts. For example, in one enhancement the upper wall 26 can be provided with a projection for fitting into and sealing the outlet 18 when the cap is applied to the container. This would form yet another seal and further assist in the prevention of leakage of material from the container 12. In an alternative embodiment, the skirt 22 can be replaced by a solid plug. While the teat 12 is shown as being connected to an exterior surface 36 of the container 12, it may of course also be connected to an interior surface of the container 12. Furthermore, the teat can be connected by any other common method such as by the use of adhesives, a screw-on retaining ring or heat welding. In addition, the teat 14 can be replaced with other types of dispensing means such as a spout for use with containers such as soft-drink bottles. Finally, the container 12 can be provided with one or more bleed holes 52 rather than only two as shown in FIGS. 5 and 6. All such modifications and variations are to be considered within the scope of the present invention, the nature of which is to be determined from the foregoing description.

The claims defining the invention are as follow:

1. A dispensing-sealing arrangement for a container having an opening and containing matter, comprising:

a resiliently deformable dispensing means connectable to the opening and having an outlet for dispensing the matter, said dispensing means including a first portion and an integral second portion containing said outlet, said second portion positioned radially inwards of said first portion; and, a cap provided with sealing means insertable into the opening for sealing said container by deforming said dispensing means so that said first portion is sandwichable between the opening and said sealing means so as to form a seal between said sealing means and said dispensing means, said sealing means being adapted to engage said second portion so that removal of said cap from said container extends said dispensing means from said opening and to subsequently release from said second portion.

2. A dispensing-sealing arrangement according to claim 1, wherein said sealing means is provided with releasable engaging means for releasably engaging said second portion of said dispensing means when said cap is inserted into the opening to extend said dispensing means from said opening as said cap is removed from said opening.

3. A dispensing-sealing arrangement according to claim 2, wherein said sealing means comprises a first skirt depending from an upper wall of said cap, said first skirt having an inner surface which, together with said upper wall, defines said engaging means for engaging said second portion by resiliently deforming said second portion against said inner surface of the first skirt.

4. A dispensing-sealing arrangement according to claim 3, wherein said outlet is located in said second portion of the dispensing means and said first skirt is configured so that said outlet abuts said upper wall when the second portion of the dispensing means is engaged in the engaging means thereby sealing the outlet.

5. A dispensing-sealing arrangement according to claim 3, wherein said cap further comprises a second skirt depending from a peripheral edge of said upper wall in the same direction as said first skirt, said second skirt being configured to fit over and releasably engage an exterior surface of said container.

6. A dispensing-sealing arrangement according to claim 5, wherein said second skirt is further configured so as to form a seal about said exterior surface.

7. A dispensing-sealing arrangement according to claim 1, wherein said dispensing means further comprises a third portion depending from said first portion and extendable through said opening into said container to a position where it can overlie a bleed hole provided in the container, whereby, when said cap is removed from said opening and the difference between ambient atmospheric pressure and pressure inside said container is greater than a predetermined pressure said third portion acts to allow fluid communication between the atmosphere and the inside of container through said bleed hole, and when said difference is less than or equal to said predetermined pressure said third portion seals said bleed hole to substantially prevent escape of contents of said container through bleed hole, and when said cap is inserted into said opening said cap deforms said dispensing means in such a manner that said first portion and said third portion are sandwiched between said opening and said sealing means with said third portion overlying said bleed hole to positively seal said opening and bleed hole.

8. A dispensing-sealing arrangement according to claim 1, wherein said dispensing means comprises one selected from the group consisting of a spout and a teat.

9. A dispensing-sealing arrangement according to claim 4, wherein said cap further comprises a second skirt depending from a peripheral edge of said upper wall in the same direction as said first skirt, said second skirt being configured to fit over and releasably engage an exterior surface of said container.

10. A dispensing-sealing arrangement according to claim 2, wherein said dispensing means further comprises a third portion depending from said first portion and extendable through said opening into said container to a position where it can overlie a bleed hole provided in the container, whereby, when said cap is removed from said opening and the difference between ambient atmospheric pressure and pressure inside said container is greater than a predetermined pressure said third portion acts to allow fluid communication between the atmosphere and the inside of container through said bleed hole, and when said difference is less than or equal to said predetermined pressure said third portion seals said bleed hole to substantially prevent escape of contents of said container through bleed hole, and when said cap is inserted into said opening said cap deforms said dispensing means in such a manner that said first portion and said third portion are sandwiched between said opening and said sealing means with said third portion overlying said bleed hole to positively seal said opening and bleed hole.

11. A dispensing-sealing arrangement according to claim 3, wherein said dispensing means further comprises a third portion depending from said first portion and extendable through said opening into said container to a position where it can overlie a bleed hole provided in the container, whereby, when said cap is removed from said opening and the difference between ambient atmospheric pressure and pressure inside said container is greater than a predetermined pressure said third portion acts to allow fluid communication between the atmosphere and the inside of container through said bleed hole, and when said difference is less than or equal to said predetermined pressure said third portion seals said bleed hole to substantially prevent escape of contents of said container through bleed hole, and when said cap is inserted into said opening said cap deforms said dispensing means in such a manner that said first portion and said third portion are sandwiched between said opening and said sealing means with said third portion overlying said bleed hole to positively seal said opening and bleed hole.

12. A dispensing-sealing arrangement according to claim 4, wherein said dispensing means further comprises a third portion depending from said first portion and extendable through said opening into said container to a position where it can overlie a bleed hole provided in the container, whereby, when said cap is removed from said opening and the difference between ambient atmospheric pressure and pressure inside said container is greater than a predetermined pressure said third portion acts to allow fluid communication between the atmosphere and the inside of container through said bleed hole, and when said difference is less than or equal to said predetermined pressure said third portion seals said bleed hole to substantially prevent escape of contents of said container through bleed hole, and when said cap is inserted into said opening said cap deforms said dispensing means in such a manner that said first portion and said third portion are sandwiched between said opening and said sealing means with said third portion overlying said bleed hole to positively seal said opening and bleed hole.

13. A dispensing-sealing arrangement according to claim 5, wherein said dispensing means further comprises a third portion depending from said first portion and extendable through said opening into said container to a position where it can overlie a bleed hole provided in the container, whereby, when said cap is removed from said opening and the difference between ambient atmospheric pressure and pressure inside said container is greater than a predetermined pressure said third portion acts to allow fluid communication between the atmosphere and the inside of container through said bleed hole, and when said difference is less than or equal to said predetermined pressure said third portion seals said bleed hole to substantially prevent escape of contents of said container through bleed hole, and when said cap is inserted into said opening said cap deforms said dispensing means in such a manner that said first portion and said third portion are sandwiched between said opening and said sealing means with said third portion overlying said bleed hole to positively seal said opening and bleed hole.

14. A dispensing-sealing arrangement according to claim 6, wherein said dispensing means further comprises a third portion depending from said first portion and extendable through said opening into said container to a position where it can overlie a bleed hole provided in the container, whereby, when said cap is removed from said opening and the difference between ambient atmospheric pressure and pressure inside said container is greater than a predetermined pressure said third portion acts to allow fluid communication between the atmosphere and the inside of container through said bleed hole, and when said difference is less than or equal to said predetermined pressure said third portion seals said bleed hole to substantially prevent escape of contents of said container through bleed hole, and when said cap is inserted into said opening said cap deforms said dispensing means in such a manner that said first portion and said third portion are sandwiched between said opening and said sealing means with said third portion overlying said bleed hole to positively seal said opening and bleed hole.

15. A dispensing-sealing arrangement according to claim 2, wherein said dispensing means comprises one selected from the group consisting of a spout and a teat.

16. A dispensing-sealing arrangement according to claim 3, wherein said dispensing means comprises a teat or a spout.

17. A dispensing-sealing arrangement according to claim 4, wherein said dispensing means comprises a teat or a spout.

18. A dispensing-sealing arrangement according to claim 5, wherein said dispensing means comprises a teat or a spout.

19. A dispensing-sealing arrangement according to claim 6, wherein said dispensing means comprises a teat or a spout.

20. A dispensing-sealing arrangement according to claim 7, wherein said dispensing means comprises a teat or a spout.

* * * * *